United States Patent [19]

Inoue et al.

[11] 4,445,067

[45] Apr. 24, 1984

[54] HIGH PRESSURE METAL VAPOR DISCHARGE LAMP WITH RADIOACTIVE MATERIAL IMPREGNATED IN CERAMIC

[75] Inventors: Akihiro Inoue, Chigasaki; Tadao Kanoh, Fujisawa; Taketo Kamei; Akihiro Kamiya, both of Yokosuka; Toshihiko Ishigami, Yokohama; Akira Kohno; Hiroki Sasaki, both of Yokohama, all of Japan

[73] Assignee: Tokyo Shibaura Denki Kabushiki Kaisha, Kawasaki, Japan

[21] Appl. No.: 265,675

[22] Filed: May 20, 1981

[30] Foreign Application Priority Data

Jun. 18, 1980 [JP] Japan ..... 55-82415
Jun. 18, 1980 [JP] Japan ..... 55-82416

[51] Int. Cl.[3] ..... H01J 65/08
[52] U.S. Cl. ..... 313/54; 313/639
[58] Field of Search ..... 313/54, 228, 638, 639

[56] References Cited

U.S. PATENT DOCUMENTS

| | | | |
|---|---|---|---|
| 2,222,093 | 11/1940 | Swanson | 313/54 X |
| 2,525,263 | 10/1950 | Macksoud | 313/54 X |
| 2,669,609 | 2/1954 | Linder | 313/54 X |
| 2,765,417 | 10/1956 | Foulke | 313/54 |
| 3,928,781 | 12/1975 | Edwards et al. | 313/54 |
| 4,044,276 | 8/1977 | Keeffe et al. | 313/346 R X |
| 4,117,370 | 9/1978 | Jacobs et al. | 315/35 |
| 4,258,289 | 3/1981 | Michael | 315/73 X |
| 4,277,725 | 7/1981 | Sneijers | 315/73 |

FOREIGN PATENT DOCUMENTS

| | | | |
|---|---|---|---|
| 1590980 | 5/1970 | France | 313/54 |
| 40-8514 | 5/1965 | Japan . | |
| 49-72971 | 7/1974 | Japan . | |
| 51-66174 | 6/1976 | Japan . | |

OTHER PUBLICATIONS

52nd Edition of Chemical Rubber Company's *Handbook of Chemistry and Physics* "Table of the Isotopes" complied by R. L. Heath, pp. B-245,246, B-248, B-250, B-256, B-260, B-261, B-263, B-264, B-267, B-294, B-308, B-319, B-334, B-352, B-355, B-363, B-373, B-386, B-470, B-477, B-481, B-501, B-503, B-506, B-529, B-532, B-533.

*Primary Examiner*—Palmer C. Demeo
*Assistant Examiner*—Sandra L. O'Shea
*Attorney, Agent, or Firm*—Oblon, Fisher, Spivak, McClelland & Maier

[57] ABSTRACT

A high pressure metal vapor discharge lamp including an arc tube having opposed ends at which are provided respective main electrodes and a fill including mercury and a starting gas, a radioactive source material including a radioactive substance having a half-life less than $1\times10^4$ years sealed in the arc tube, an outer tube enclosing the arc tube and a circuit for starting the arc tube.

2 Claims, 2 Drawing Figures

HIGH PRESSURE METAL VAPOR DISCHARGE LAMP WITH RADIOACTIVE MATERIAL IMPREGNATED IN CERAMIC

BACKGROUND OF THE INVENTION 1. Field of the Invention

This invention relates generally to a high pressure metal vapor discharge lamp, and more particularly to such a lamp using a radioactive substance in an arc tube.

2. Description of the Prior Art

A high pressure metal vapor discharge lamp, i.e. a metal-halide lamp, uses thorium oxide, barium oxide and so on as an electron-emitting material which is coated on an electrode or otherwise fixed on an electrode. Making use of electrons released from the thorium by $\alpha$-decay to initiate starting such a lamp is known from U.S. Pat. No. 4,044,276. Namely a conventional 400 W metal-halide lamp is provided with about 20 mg thorium oxide on its electrode. It is known that the half-live of thorium is $1.4\times10^{10}$ years and the number of atoms in 20 mg thorium oxide is about $4.54\times10^{19}$. So, it is considered that the number of decaying atoms from 20 mg thorium oxide during every second is 72, based on a decay constant of $1.6\times10^{-18}$ $sec^{-1}$. Namely, provided one electron is produced from one $\alpha$ particle, the number of initial electrons from 20 mg thorium oxide is 72 per second.

Meanwhile, a mean starting time ($\tau$), i.e. the time from switching on till the beginning of discharge, is a function of the number (Q) of initial electrons and the probability (P) of one released electron starting discharge.

Namely, $$\tau=1/P.Q$$

Where, Q is 72 in 20 mg thorium oxide and P is considered to be about 0.5, then from the formula $\tau$ is 0.028 second.

When thorium oxide is not used the the only source of supply for initial electrons is natural radioactive radiation, i.e. cosmic rays. Consequently $\tau$ is about 20 seconds on account of reduced values of Q, for example $Q\simeq0.1$.

Thus, when using thorium oxide, it is easy to start discharge, which contributes to a short starting time. But the half-life of the above mentioned thorium is comparatively long, such as $1.4\times10^{10}$ years. In order to assure reliable discharge starting near the end of lamp life, such as after six years it is desirable to release at least one electron from the thorium during one cycle of the alternating power source applied to the lamp. For the number of decaying particles required after six years use, it is necessary for the thorium to release from 50 to 60 electrons during every second assuming a 50–60 Hz power source. Consequently, to satisfy the above mentioned conditions, a conventional 400 W lamp needs about 20 mg thorium oxide.

However, the arc tube also contains a halogen of metal halide with which the thorium is apt to react to become thorium halide. The resultant thorium halide reduces radiation of the other sealed metal, so the thorium halide is one cause of decreasing lumen output. Moreover, the vapor of the thorium halide raises the lamp voltage during lighting.

As above mentioned, the amount of the thorium oxide provided to release electrons is to be decreased on account of its reacting with the halogen. But it is necessary to use a greater amount of the thorium oxide to maintain stable starting discharge near the end of lamp life, for example 10,000 hours.

SUMMARY OF THE INVENTION

In view of the state of the art as above described, the inventors concentrated upon using a short half-life radioactive substance which can be used in smaller amounts instead of the long half-life radioactive substance, such as thorium.

However, it is noted that the short half-life radioactive substance may adversely affect the human body compared to the long half-life radioactive substance due to the relatively higher radioactive emission. So it might be necessary for persons who handle such a substance during manufacture to take extra safety precautions unless other measures are taken.

Accordingly, one object of this invention is to provide a novel high pressure metal vapor discharge lamp using a short half-life radioactive substance.

Another object of this invention is to provide a novel high pressure metal vapor discharge lamp exhibiting improved starting characteristics.

Yet another object of this invention is to provide a novel high pressure metal vapor discharge lamp exhibiting high safety in spite of using a short half-life radioactive substance.

These and other objects have now been achieved according to this invention by providing a novel high pressure metal vapor discharge lamp in which is sealed a radioactive source material impregnated with a radioactive substance having a half-life less than $1\times10^4$ years.

BRIEF DESCRIPTION OF THE DRAWINGS

A more complete appreciation of this invention and many of the attendant advantages thereof will be readily obtained as the same becomes better understood by reference to the following detailed description when considered in connection with the accompanying drawings wherein.

DESCRIPTION OF THE PREFERRED EMBODIMENTS

Figure 1:
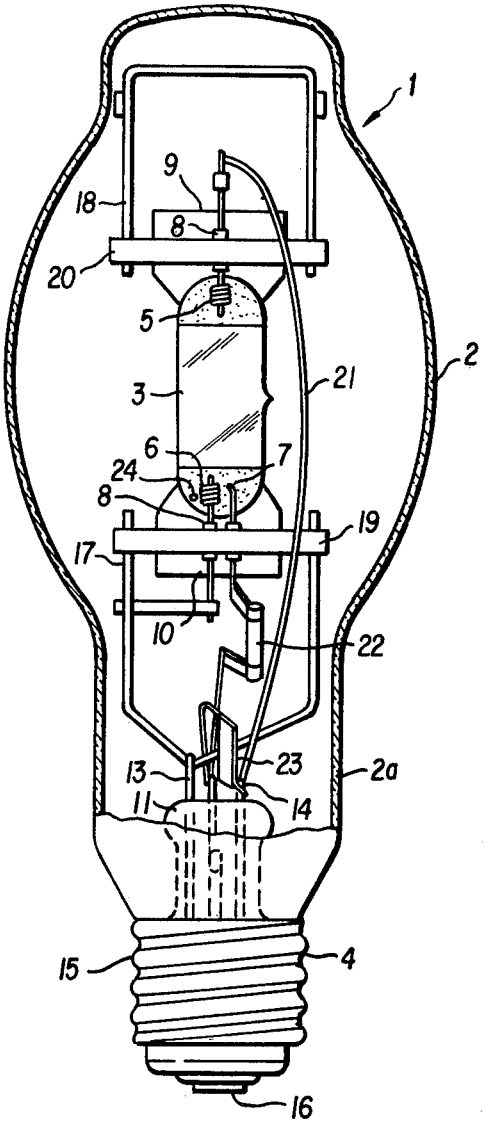
FIG. 1 is a longitudinal elevational view, partly in cross-section of a high pressure metal vapor discharge lamp according to this invention.
Figure 2:
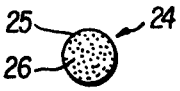
FIG. 2 is a schematic illustration of a radioactive source material according to this invention.

Referring now to the drawings wherein like reference numerals designate identical or corresponding parts through the several views, and more particularly to FIG. 1 thereof, a metal-halide lamp 1 comprises a vitreous outer bulb 2 and a discharge tube, i.e. a quartz arc tube 3, the outer tube 2 having a screw base 4 at one end thereof. The arc tube 3 contains a quantity of mercury which is substantially completely vaporized and exerts a pressure from 1 to 10 atmospheres in operation, a quantity of sodium iodide and scandium iodide. An inert rare gas, for instance krypton at a pressure of 50 torr, is included in the arc tube 3 to facilitate starting and warm-up. Opposed main electrodes 5, 6 are mounted at opposite ends of the arc tube 3 and a starting electrode 7 is provided near the main electrode 6. The electrodes 5, 6 are supported on leads which include thin molybdenum foil sections 8 extending through respective pinch sealed ends 9, 10 of the arc tube 3. Main electrodes 5, 6 each include a tungsten wire around which a helix may be wrapped. The starter electrode 7 may be a fine tungsten wire having only the tip thereof projecting into the arc tube 3.

A neck part 2*a* of the outer tube 2 is sealed by a stem 11 through which extend stiff lead wires 13, 14 which are respectively connected at their outer ends to the screw shell 145 and to the outer contact 16 of the base 4.

The pinch sealed parts of the arc tube 3 are fixed to support structures 17, 18 by way of metal holder 19, 20. The support structure 17 is connected to a lead wire 13 by welding. The main electrode 6 is connected to the support structure 17 and the other main electrode 5 is connected to a lead wire 14 by way of a lead wire 21. The starting electrode 7 is connected to a starting resistor 22. The starting resistor 22 is connected to the lead wire 14 by way of a bimetal switch 23 adapted to close at a normal temperature and to open above a predetermined temperature.

Further, a radioactive source material 24 is sealed in the arc tube 3. The radioactive source material 24 consists of a ceramic material, i.e. aluminum oxide ($Al_2O_3$) and silicon oxide ($SiO_2$), impregnated with promethium ($^{147}Pm$) about 0.1 micro curie (0.1 $\mu$Ci). The half-life of $^{147}Pm$ is 2.5 years and less than $1\times10^4$ years. The following is one possible way of making such a radioactive source material. Namely, first aluminum oxide ($Al_2O_3$), silicon oxide ($SiO_2$) and sodium oxide ($Na_2O_3$) are mixed at a predetermined ratio and burned at about 2000° C. So the ceramic body is formed consisting of $xAl_2O_3.ySiO_2zNA_2O_3$. Where x, y, z refer respectively to the molar ratio. Sodium (Na) atoms of the above ceramic body are replaced with promethium ($^{147}Pm$) atoms by a well known method, i.e. an ion exchange method. Namely, the above ceramic body $xAL_2O_3.ySiO_2.zNa_2O_3$ is to be changed to $xAL_2O_3.ySiO_2.z(NH_4)_2O$ by steeping in a liquid of ammonium chloride ($NH_4CL$). Next by a treatment of taking off ammonium ($NH_3$) of $xAl_2O_3.ySiO_2.z(NH_4)_2O$ it is rendered to be $xAl_2O_3.ySiO_2.z.H_2O$. Next, $xAl_2O_3.ySiO_2.zH_2O$ is reduced to $xAl_2O_3.ySiO_2.zHPmO$ by replacing hydrogen (H) of $xAl_2O_3.ySiO_2.zH_2O$ with promethium ($^{147}$ Pm). Finally, by sintering at about 1200° C., a desired radioactive source material 24 can be had.

Moreover the radioactive material 24 manufactured by the above mentioned method is safe to the human body because the radioactive substance 26 is impregnated into the material 25 i.e. a ceramic consisting of aluminum oxide and silicon oxide.

The safety to the human body has been proven by the well known smear test.

Moreover, the radioactive source material 24 impregnated with the radioactive substance 26 can easily be made in varying sizes and shapes, for example it can be made smaller than the exhaust diameter of the arc tube 3. So the step of sealing the source material 24 into the arc tube 3 during manufacturing can occur either before the exhausting step or after the exhausting step.

In such a metal-halide lamp using the above mentioned radioactive source material 24, even immediately after switching on the lamp many initial electrons always exist released from the radioactive source material 24 in the arc tube 3. Consequently, the electrons are used as a seed to initiate discharge starting, and the starting of the lamp 1 is quick and certain. Namely, the starting characteristics, i.e. the starting propensity of the lamp 1, compared to the conventional lamp, is improved.

Furthermore notwithstanding the use of a short half-life radioactive substance 26, compared to a conventional long half-life radioactive substance, there is no danger to the human body who handles the radioactive source material 24.

However, it should be understood that other than ceramic materials can be used for the material 25. For example, it is possible to impregnate the short half-life radioactive substance into metals, such as the metals which are sealed in the arc tube 3, or the same material forming the electrode 5, 6 and 7, i.e. tungsten or molybdenum. Namely it is possible to impregnate at least one of the following substances, or an oxide thereof or a halide thereof with the short half-life radioactive substance: sodium (Na), calcium (Ca), scandium (Sc), cesium (Cs), tin (Sn), thallium (Tl), indium (In), aluminum (Al) and rare earth metals.

As a radioactive substance 26, It is prefered that the half-life thereof is from 0.5 year to $1\times10^4$ years. For example, carbon ($^{14}C$), sodium ($^{22}Na$), calcium ($^{45}Ca$), manganese ($^{54}Mn$), iron ($^{55}Fe$), cobalt ($^{60}Co$), nickel ($^{63}Ni$), zinc ($^{65}Zn$), strontium ($^{90}Sr$), lutetium ($^{106}Lu$), silver ($^{110}Ag$), antimony ($^{125}Sb$), barium ($^{133}Ba$), cesium ($^{134}Cs$, $^{137}Cs$), cerium ($^{144}Ce$), prometium ($^{147}Pm$), europium ($^{154}Eu$ $^{155}Eu$), gold ($^{195}Au$), thallium ($^{204}Tl$), lead ($^{210}Pb$), radium ($^{226}Ra$, $^{228}Ra$), actinium ($^{227}Ac$), thorium ($^{228}Th$), americium ($^{241}Am$), and curium ($^{242}Cm$, $^{244}Cm$) are possible candidates.

Another method of making the radioactive source material 24 is possible. That is a powder of the same substance of the sealed metals or electrode material is mixed uniformly with a very small quantity of powder of a radioactive substance. Next, the mixed powder is heated to a molten state and then formed into a pellet for use as the radioactive source material 24.

If the material 25 is an oxide, the oxide is made into a paste by mixing a organic solder, such as butyl acetate, with a powder of radioactive substance 26. After forming into a pellet by compressing the mixture, it is heated to the molten state to produce the radioactive source material 24.

If the material 25 is a halide, the halide and the radioactive substance 26 are mixed and heated to a molten state. After that by dropping the molten mixture in an inert gas and by cooling the molten mixture, a radioactive source material 24 can be formed.

Next described is the reason why a radioactive substance 26 having a half-life from 0.5 year to $1\times10^4$ years is used.

Generally speaking, a high pressure metal vapor lamp including a metal-halide lamp has a useful life of about 10,000 hours. If a lamp is lighted for about 5 hours a day, it is necessary to operate normally for six years. Consequently, if a radioactive substance 26 has a half-life over 0.5 year, it will be $(\frac{1}{2})2\times6=(\frac{1}{2})^{12}=2.4\times10^{-4}$ after six years. Namely, there remains an ability of releasing an electron which is sufficient to start discharge even after six years. But if the half-life is less than 0.5 year, the ability of releasing an electron is not sufficient to last the life of the lamp.

On the one hand, if the half-life is too long, the number of released electrons is extremely reduced. If insufficient electrons are released, it becomes necessary to provide a large quantity of a radioactive substance to assure starting. But a large quantity of a radioactive substance sealed in the arc tube reacts with other sealed substances, such as halides which causes decreased lumen output. It is known that it is desirable to maintain the total atomic number of the radioactive substance to less than $10^{-3}$ times the total vaporized atomic number of the metal sealed in the arc tube to prevent decreased lumen output and a blacking of the arc tube. Therefore, less than $10^{-6}$ g of a radioactive material having a half life-less than $10^4$ years is required to be sealed in the arc tube to assure starting during the life of the lamp, compared to 20 mg. of thorium required in the conventional lamp.

Moreover, in some countries, such as Japan, a maximum 100 micro curie (100 $\mu$Ci) of a radioactive substance is permitted to be used. So it is necessary to use less than 100 $\mu$Ci per arc tube. As aforementioned it is necessary to release from 50 to 60 electrons desirably about 100 electrons, per second to maintain stable starting near the end of the lamp life, i.e. after about six years.

With regard to a 0.5 year half-life radioactive substance, it is necessary to have about $2.3\times10^9$ atoms after six years, such that about $1\times10^{13}$ atoms of total elementary number are required at the beginning of the lamp life.

With regard to a $1\times10^4$ years half-life radioactive substance, it is necessary to have about $4.5\times10^{14}$ atoms at the beginning of the lamp life and after six years.

Consequently, the number of required atoms of radioactive substance of this invention is less by a factor of from $10^{-5}$ to $10^{-7}$ times compared to the conventional lamp using a thorium in 20 mg thorium oxide, which includes $4.54\times10^{19}$ atoms.

EXAMPLE 1

80 torr krypton gas, 30 mg scandium-sodium iodide, 50 mg radioactive source material consisting of $Al_2O_3$.-$SiO_2$.PmO and mercury were sealed in an arc tube for a 100 W lamp. The lamps using this arc tube started immediately, but the conventional lamp not including $^{147}$Pm took over 20 seconds to start.

EXAMPLE 2

80 torr argon gas, 5 mg scandium-sodium iodide, 1 mg radioactive source material consisting of $Al_2O_3$.$SiO_2$.PmO and mercury were sealed in an arc tube for a 100 W lamp. This lamp started immediately using this arc tube, but it took about 18 seconds to start the conventional lamp not including $^{147}$Pm.

EXAMPLE 3

50 torr argon gas, 60 mg cerium-samarium-sodium iodide, a radioactive source material consisting of ceramic $SiO_2$.CaO.MgO impregnated with $^{22}$Na and mercury where sealed in an arc tube for a 1 kW lamp. This lamp started immediately, but it took about 20 seconds to start the conventional lamp not including $^{22}$Na.

EXAMPLE 4

80 torr neon-krypton mixture gas, 60 mg scandium-sodium iodide, 2 mg scandium metal, a radioactive source material consisting of $SiO_2$ impregnated with $^{14}$C and mercury were sealed in an arc tube for a 1 kW lamp. This lamp started immediately but it took about 25 seconds to start the conventional lamp not including $^{14}$C.

EXAMPLE 5

25 torr argon gas, 30 mg sodium-thorium-indium iodide, 0.5 mg radioactive source material consisting of indium metal impregnated with $^{147}$Pm and mercury were sealed in an arc tube for a 400 W lamp. This lamp started immediately, but it took about 5 seconds to start the conventional lamp not including $^{147}$Pm.

EXAMPLE 6

100 torr argon gas, 30 mg scandium-sodium iodide, 2 mg radioactive source material consisting of scandium metal impregnated with $^{63}$Ni and mercury were sealed in an arc tube for a 400 W lamp. This lamp started immediately, but it took about 2 minutes to start the conventional lamp not including $^{63}$Ni.

EXAMPLE 7

80 torr argon gas, 5 mg scandium-sodium iodide, a radioactive source material formed by sintering mixed powders consisting of tungsten powder, tungsten oxide powder and $^{60}$Co oxide powder and mercury were sealed in an arc tube for a 100 W lamp. This lamp started immediately, but it took about 18 second to start the conventional lamp not including $^{60}$Co.

In such a lamp using an arc tube which includes a radioactive source material impregnated with a radioactive substance having a half-life less than $1\times10.^4$ years, the characteristics of starting is clearly improved.

Moreover, it is easy to handle such a radioactive source material and it is safe to the human body who handles it.

Further, such a radioactive source material does not influence other sealed substances in the arc tube.

Although in the above description, a metal-halide lamp was used as an example, the principle of the invention is applicable, without essential modifications, to other lamps, for example to a high pressure mercury vapor lamp and to a high pressure sodium lamp.

Obviously numerous modifications and variations oof this invention are possible in light of the above teachings. It is therefore to be understood that within the scope of the appended claims, the invention may be practiced otherwise than as specifically described herein.

What is claimed as new and desired to be secured by Letters Patent of the United States is:

1. A high pressure metal vapor discharge lamp comprising:

an arc tube having a pair of main electrodes mounted at opposed ends of the arc tube, said arc tube provided with a fill including mercury and a starting gas;

a radioactive source material including a ceramic material impregnated with a radioactive substance having a half-life less than $1\times10^4$ years sealed in said arc tube;

an outer tube enclosing said arc tube; and a circuit for starting said arc tube.

2. The high pressure metal vapor discharge lamp of claim 1, wherein said ceramic material comprises:

alumina and silica.

* * * * *